US009057152B2

(12) United States Patent
Park et al.

(10) Patent No.: US 9,057,152 B2
(45) Date of Patent: Jun. 16, 2015

(54) LAUNDRY TREATING APPARATUS

(75) Inventors: Hye Yong Park, Changwon-si (KR); Kwang Hee Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/515,768

(22) PCT Filed: Dec. 14, 2010

(86) PCT No.: PCT/KR2010/008943

§ 371 (c)(1),
(2), (4) Date: Jun. 13, 2012

(87) PCT Pub. No.: WO2011/074858

PCT Pub. Date: Jun. 23, 2011

(65) Prior Publication Data

US 2012/0247157 A1 Oct. 4, 2012

(30) Foreign Application Priority Data

Dec. 15, 2009 (KR) ..... 10-2009-0124597

(51) Int. Cl.

| | |
|---|---|
| ***D06F 37/00*** | (2006.01) |
| ***D06F 58/10*** | (2006.01) |
| ***D06F 58/20*** | (2006.01) |

(52) U.S. Cl.

CPC ..... *D06F 58/10* (2013.01); *D06F 58/203* (2013.01)

(58) Field of Classification Search

CPC ..... D06F 58/10; D06F 58/203; D06F 39/12; D06F 58/04; D06F 73/02

USPC ..... 68/5 C, 12.08, 222, 264, 265, 5 R; 134/200, 30, 37, 102.1, 102.3, 22.15; 8/137, 142; 34/218, 132, 130, 72

See application file for complete search history.

(56) References Cited

U.S. PATENT DOCUMENTS

| | | | | |
|---|---|---|---|---|
| 5,305,484 | A * | 4/1994 | Fitzpatrick et al. | 8/149.3 |
| 2009/0255141 | A1 * | 10/2009 | Moon et al. | 34/72 |

FOREIGN PATENT DOCUMENTS

| | | | |
|---|---|---|---|
| DE | 2327000 | A1 | 12/1974 |
| EP | 0324589 | A1 | 7/1989 |
| KR | 10-2009-0014050 | | 2/2009 |
| KR | 10-2009-0014056 | | 2/2009 |
| KR | 10-2009-0114987 | | 11/2009 |
| WO | WO 2006/097383 | A1 | 9/2006 |
| WO | WO 2009/020329 | A2 | 2/2009 |

* cited by examiner

*Primary Examiner* — Michael Barr
*Assistant Examiner* — Thomas Bucci
(74) *Attorney, Agent, or Firm* — McKenna Long & Aldridge LLP

(57) ABSTRACT

The present invention relates to a laundry treating apparatus which can make clothes drying, deodoring, crumple removal and sterilization easily. The present invention has advantages of providing a laundry treating apparatus which can make easy maintain and repair of the steam generator which is to supply steam to the clothes and the air supply unit which is to supply air to the clothes.

5 Claims, 7 Drawing Sheets

LAUNDRY TREATING APPARATUS

This application is a National Stage Entry of International Application No. PCT/KR2010/008943, filed Dec. 14, 2010, and claims the benefit of Korean Application No. 10-2009-0124597, filed on Dec. 15, 2009, each of which is hereby incorporated by reference for all purposes as if fully set forth herein.

TECHNICAL FIELD

The present invention relates to a laundry treating apparatus which can make clothes drying, deodoring, crumple removal and sterilization, easily.

BACKGROUND ART

In general, the laundry treating apparatus, being an apparatus for performing various functions required for management of the clothes, is a concept including washing machines for washing the clothes, dryers for drying wet clothes, and refreshers for removal of odor and crumples from the clothes.

It is a recent trend that the laundry treating apparatus is developed to solve the troubles of the clothes washing, drying, deodoring, and crumple removal with one apparatus. However, since a recent laundry treating apparatus uses a drum for holding the clothes therein and a driving unit for rotating the drum, the laundry treating apparatus has been somewhat inadequate for deodoring and removal of crumples from the clothes.

That is, in general, since a related art laundry treating apparatus progresses the deodoring and removal of crumples while the drum is rotated, and the clothes in the drum is not in a spread state, but in a crumpled state, the laundry treating apparatus has a limitation in the deodoring and the removal of crumples.

Moreover, since the related art laundry treating apparatus transmits heat to the clothes directly from a heater therein, the laundry treating apparatus is liable to cause damage to the clothes.

Furthermore, the related art laundry treating apparatus has a structure in which maintenance of a steam supplying unit or an air supply unit provided for the clothes drying, deodoring, crumple removal and sterilization is difficult.

DISCLOSURE

Technical Problem

To solve the problems, an object of the present invention is to provide a laundry treating apparatus which can make clothes drying, deodoring, crumple removal and sterilization, easily.

Another object of the present invention is to provide a laundry treating apparatus which can prevent clothes from damaging and reduce power consumption.

Another object of the present invention is to provide a laundry treating apparatus which has a structure in which maintenance of a steam generator and an air supplying unit is easy.

Technical Solution

To achieve these objects and other advantages and in accordance with the purpose of the invention, as embodied and broadly described herein, a laundry treating apparatus includes an inner cabinet which forms a space for holding clothes, a machinery room provided separate from the inner cabinet, an air module base mounted slidably attachable/detachable to/from the machinery room to support an air supplying unit which is to supply air or hot air to the inner cabinet, and a steam module base mounted slidably attachable/detachable to/from the machinery room to support a steam generator which is to supply steam to the inner cabinet.

In this case, the machinery room can be provided to a lower portion of the inner cabinet.

In the meantime, the laundry treating apparatus can further include a base coupling member for coupling the steam module base and the air module base, together.

In this case, the machinery room can further include a base frame for supporting the base coupling member for making the steam module base and the air module base slidable.

And, the base frame can further include sliding guides which are upward extensions, and the base coupling member can further include a guide receiving rib for receiving the sliding guide.

And, the base coupling member can include a side body in contact with outside circumferential surfaces of the steam module base and the air module base, and base fastening projections projected from the side body toward the steam module base and the air module base, respectively, and the steam module base and the air module base can further include fastening projection receiving holes for receiving the fastening projections therein, respectively.

And, the base coupling member can further include a supporting body provided bent from the side body for supporting bottoms of the steam module base and the air module base.

And, the guide receiving rib is an extension which is extended from an outside surface of the side body and bent toward the base frame direction.

And, the sliding guides can further include sloped portions in a direction the steam module base and the air module base are inserted, respectively.

In the meantime, the laundry treating apparatus can further include an outer cabinet which forms an exterior of the laundry treating apparatus and provides a space in which the inner cabinet and the machinery room are formed, and the outer cabinet can include a machinery room cabinet for selectively opening one side of the machinery room.

In this case, the machinery room cabinet can be provided to a rear side of the machinery room.

In the meantime, the machinery room further includes a base frame having sliding guides for supporting the steam module base and the air module base, and the steam module base and the air module base further include guide receiving rib provided to receive the sliding guide.

In this case, the sliding guides can further include sloped portions in a direction the steam module base and the air module base are inserted, respectively.

In this case, the laundry treating apparatus can further include an outer cabinet which forms an exterior of the laundry treating apparatus and provides a space in which the inner cabinet and the machinery room are formed, and the outer cabinet can include a machinery room cabinet for selectively opening one side of the machinery room.

And, the machinery room cabinet is provided to a rear side of the machinery room.

Advantageous Effects

The present invention can provide a laundry treating apparatus which can make clothes drying, deodoring, crumple removal and sterilization easily.

And, the present invention can provide a laundry treating apparatus which can prevent the clothes from damaging and reduce power consumption.

And, the present invention can provide a laundry treating apparatus having a structure in which maintenance and repair of the steam generator and the air supply unit is easy.

BEST MODE

Reference will now be made in detail to the specific embodiments of the present invention, examples of which are illustrated in the accompanying drawings.

As far as there is no particular definition, all terms in the specification are the same with a general meaning of the term understood by persons skilled in this field of art, and, if the term used in the specification conflicts with the general meaning of the term, the meaning of the term used in the specification prevails.

In the meantime, a configuration or a control method of a device described hereinafter is provided only for describing embodiments of the present invention, but not for limiting scope of patent rights of the present invention. Wherever possible, the same reference numbers will be used throughout the drawings to refer to the same or like parts.

A preferred embodiment of the present invention will be described with reference to the attached drawing in detail.

Figure 1:
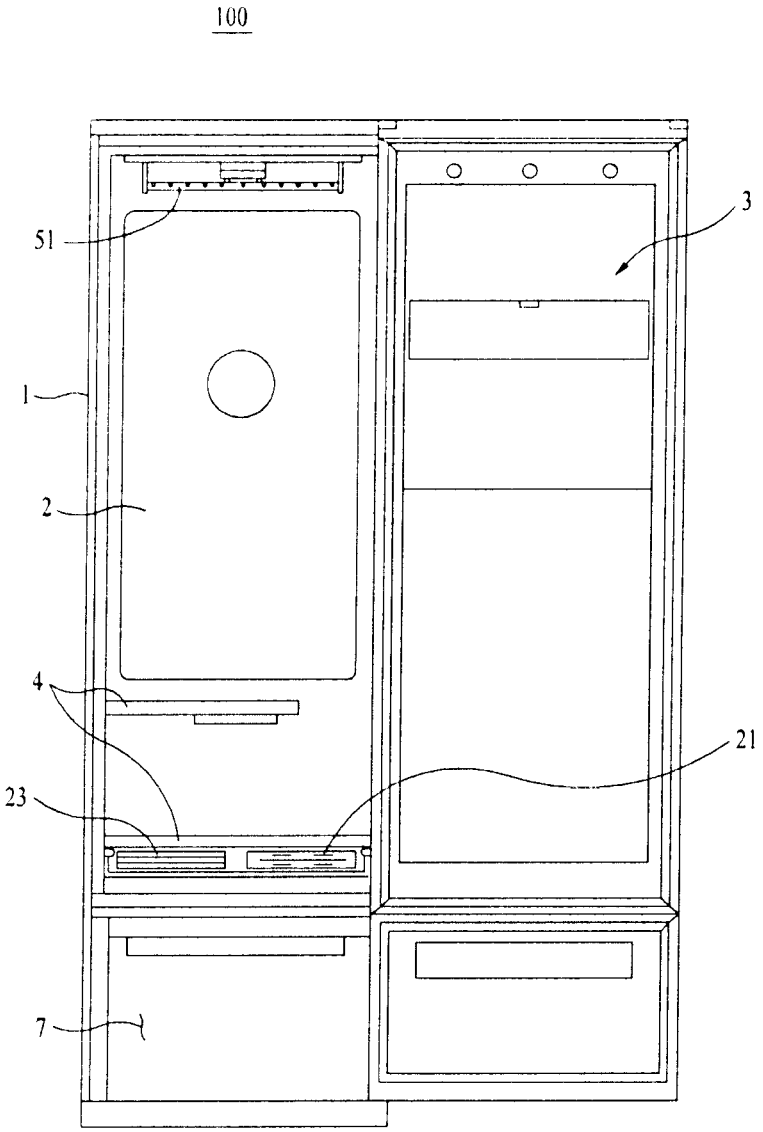
FIG. 1 illustrates a front view of a laundry treating apparatus.

FIG. 1 illustrates a front view of a laundry treating apparatus in accordance with a preferred embodiment of the present invention with doors thereof opened.

Though the specification describes a laundry treating apparatus taking a refresher which refreshes clothes and supplies hot air as an example, the present invention is not limited to this, but an aspect of the present invention is applicable to other apparatus provided with a heat pump for treating clothes described later, too.

The term of 'refresh' used in the specification means a process of supplying air, heated air, water, mist, steam, or so on to clothes for removing wrinkles, deodorizing, sanitizing, preventing static electricity and warming of the clothes.

Moreover, the clothes mentioned in the specification includes all objects that can be washed, including, not only the clothes and the apparel, but also objects that people can wear, such as shoes, socks and stockings, gloves, headgears, mufflers, and so on, as well as objects people use, such as dolls, towels, blankets, and so on.

Referring to FIG. 1, the laundry treating apparatus 100 includes an outer cabinet 1 which forms an exterior of the laundry treating apparatus, an inner cabinet 2 which provides a space for holding clothes, a door 3 of opening and closing the inner cabinet 2, supporters 4 and 51 for placing the clothes in the inner cabinet, and a machinery room 7 having an air supply unit for supplying air or hot air to the inner cabinet 2 and a steam generator for supplying water, mist, or steam to the inner cabinet 2 provided thereto.

Figure 4:
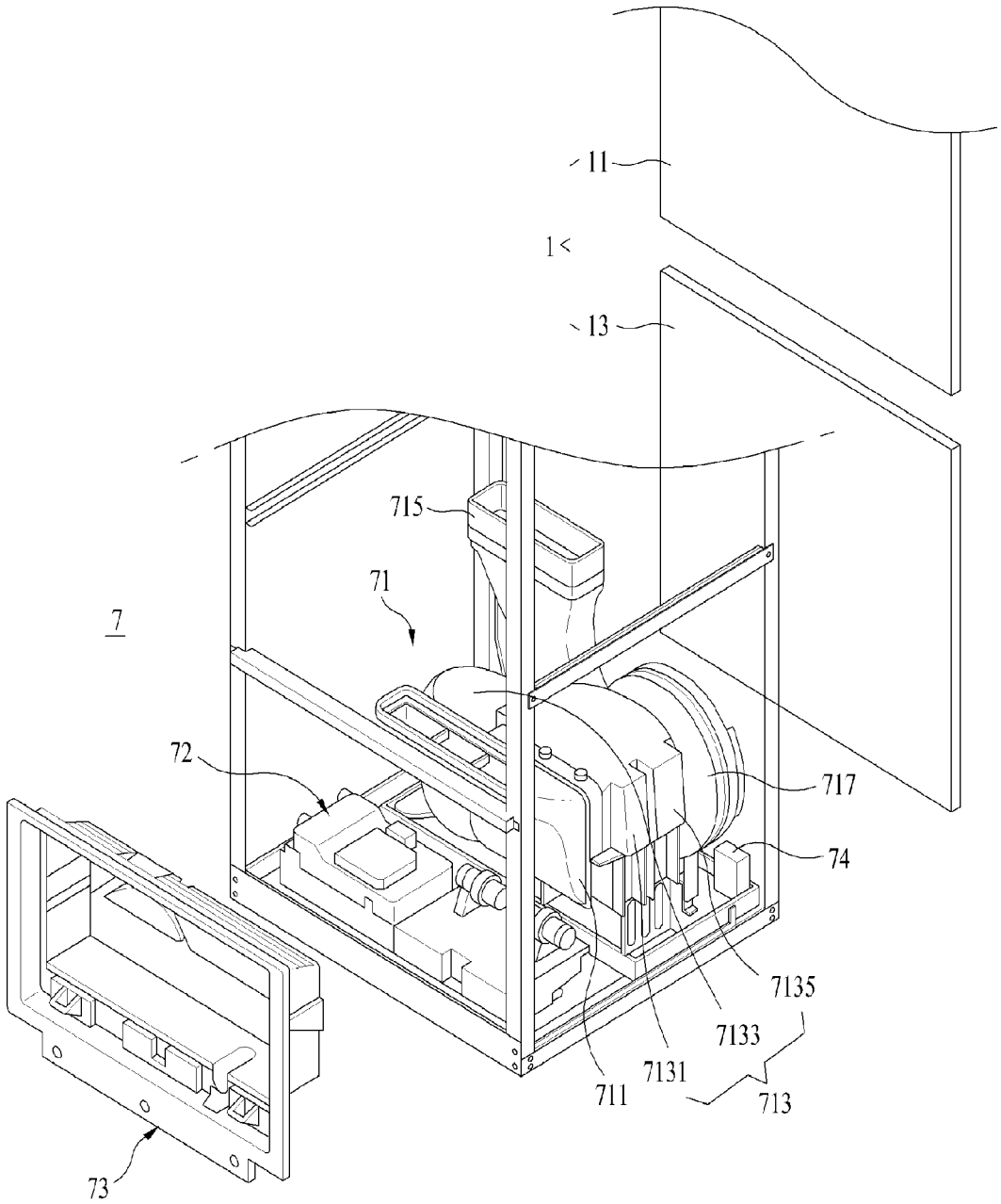
FIG. 4 illustrates a schematic view of a machinery room.

It is preferable that the inner cabinet 2 has an air inlet 23 in communication with the air supply unit 71 (See FIG. 4) and a filter unit 25 (See FIG. 5), and a steam inlet 21 in communication with the steam spray unit 72 (See FIG. 4).

The supporters can be fixedly secured to the inner cabinet such that the clothes can be refreshed by the hot air or steam being supplied from the air supply unit or the steam generator while the clothes is stationary.

That is, the supporters can be shelves 4 fixedly secured to an inner circumference of the inner cabinet and a hanger bar 51 fixedly secured to an upper portion of the inner cabinet. In this case, it is preferable that each of the shelves 4 has a frame shape having opened upper and lower faces for allowing the hot air or the steam from the machinery room 7 to pass therethrough, for easy supply of the hot air or steam to the clothes on the shelves.

Accordingly, since the clothes introduced to the laundry treating apparatus of the present invention is not in an entangled state like the clothes introduced to the related art drum type laundry treating apparatus, the laundry treating apparatus of the present invention can expect an excellent effect, not only in deodoring and crumple removal, but also in drying of the clothes.

However, the hanger bar 51 at the upper portion of the inner cabinet 2 can be a moving hanger which can shakes the clothes in a horizontal direction (in left/right directions or front/rear directions). In this case, since the moving hanger makes the clothes not to entangle with one another even if the moving hanger shakes the clothes while the hot air or the steam is supplied to the inner cabinet 2, the moving hanger can improve the clothes drying, deodoring, crumple removal, and sterilization efficiency, further.

That is, an increased clothes refresh performance can be expected.

Figure 2:
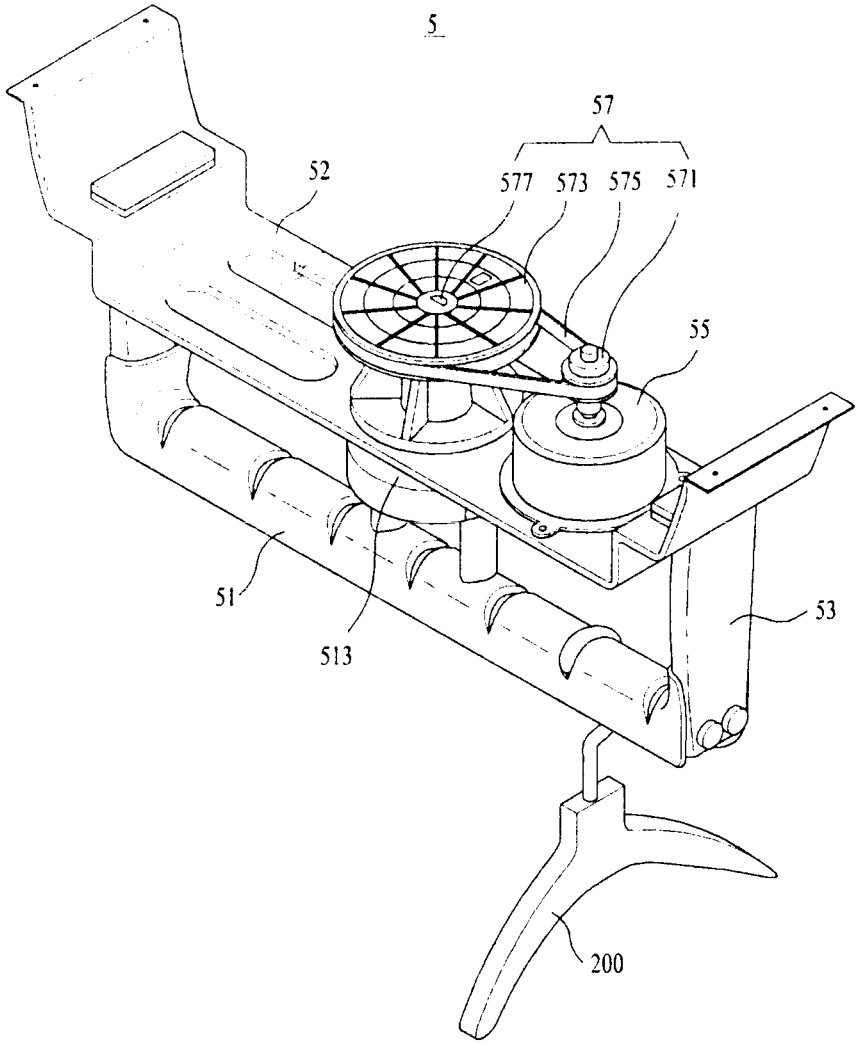
FIG. 2 illustrates an assembled perspective view of a moving hanger.
Figure 3:
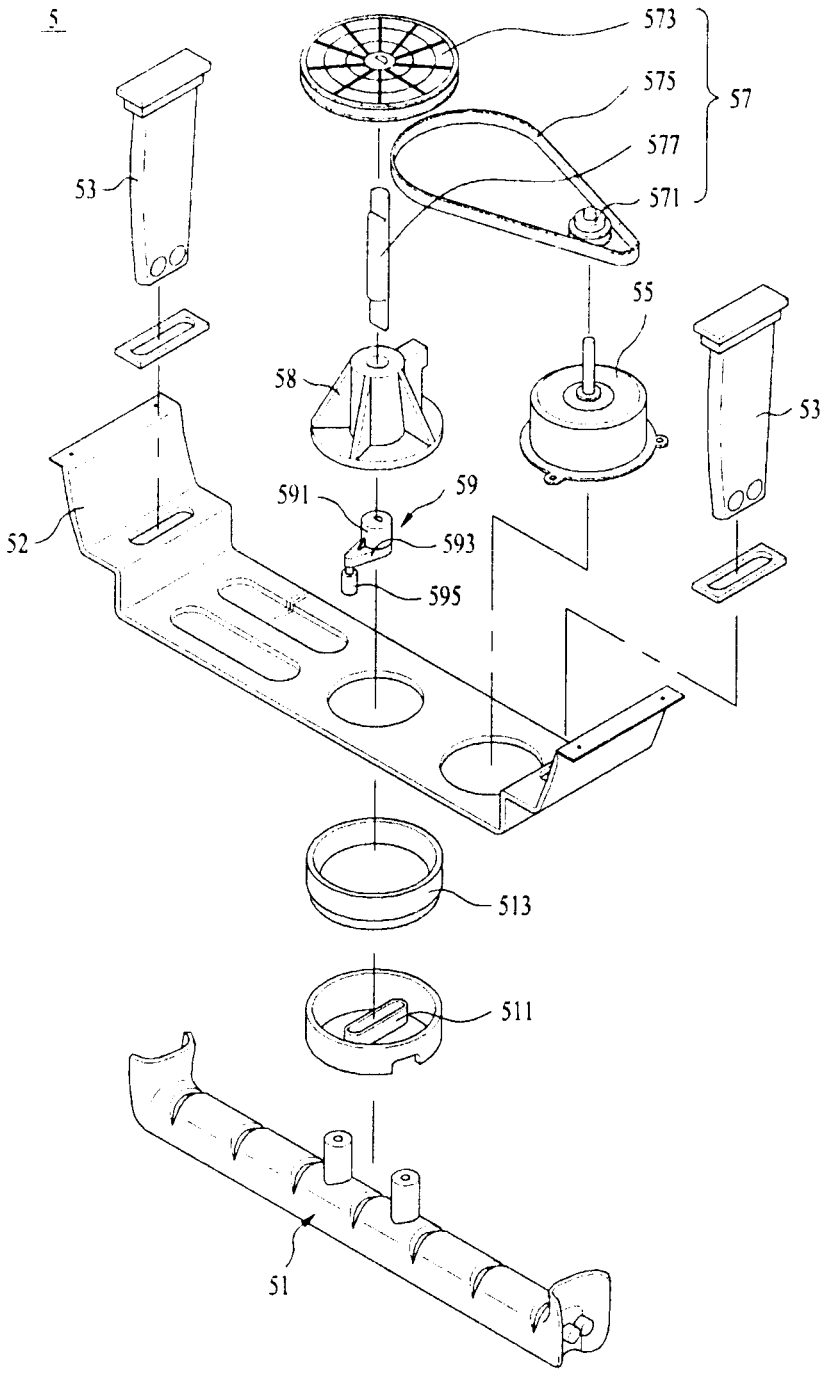
FIG. 3 illustrates an exploded perspective view of a moving hanger.

FIG. 2 illustrates an assembled perspective view of the moving hanger, and FIG. 3 illustrates an exploded perspective view of the moving hanger. The moving hanger will be described with reference to FIGS. 2 and 3.

Referring to FIGS. 2 and 3, the moving hanger 5 includes a hanger bar 51 for hanging a clothes hanger 200 therefrom having the clothes placed thereon, and a holder 53 for holding both ends of the hanger bar 51. The holder 53 can be provided to the upper portion of the inner cabinet 2, and the hanger bar 51 can have both ends thereof connected to the holder 53.

Accordingly, since the laundry treating apparatus of the present invention has the clothes introduced thereto placed on the clothes hanger, not only an excellent refreshing effect, but also an excellent drying effects can be expected in comparison to the related art laundry treating apparatus.

In the meantime, the moving hanger 5 includes a motor 55, a power converting portion 59 for converting a rotation motion from the motor 55 into a linear horizontal motion of the hanger bar 51, a power transmission portion 57 for transmission of power from the motor 55 to the power converting portion 59, and a frame 52 provided to an outside circumference of an upper end of the inner cabinet for holding above elements.

The power transmission portion 57 can be provided to include a drive pulley 571 provided to the motor 55, a driven pulley 573 connected to the drive pulley with a belt 575, a rotation shaft 577 coupled to a center of the driven pulley. It is preferable that the clothes hanger bar 51 is provided to include a slot 511 perpendicular to a length direction thereof. And, the power converting portion 59 can be provided to include a slot inserting portion 595 to be inserted in the slot 511, a shaft coupling portion 591 to be coupled to the rotation shaft 577, and a rotation arm 593 connected between the slot inserting portion and the shaft coupling portion.

In this case, a bearing housing 58 can be provided between the shaft coupling portion and the driven pulley for supporting rotation of the rotation shaft further, and a converting portion cover 513 can be included further for preventing the power converting portion from being exposed to an outside in view of sense of beauty.

In above configuration, since the driven pulley 573 rotates if the motor 55 rotates, the rotation shaft 577 coupled to the driven pulley rotates, causing the slot inserting portion 595 to make a circular motion to have a predetermined diameter.

In the meantime, the slot 511 in the hanger bar 51 is perpendicular to the length direction of the hanger bar and has a length greater than a diameter of a rotation locus of the slot inserting portion 595.

Accordingly, the slot 511 will make a linear motion in a length direction of the hanger bar 51 even if the slot inserting portion 595 makes a circular motion. However, if the slot 511 is parallel to the length direction of the hanger bar 51, the hanger bar will make a linear motion in a direction perpendicular to the length direction of the hanger bar.

It is preferable that the machinery room 7 has the air supply unit 71 for supplying air or hot air to the inner cabinet 2, and the steam generator 72 for supplying water, mist or steam (hereafter steam) to the inner cabinet, and is provided at a lower portion of the inner cabinet. The machinery room 7 is positioned at the lower portion of the inner cabinet 2 because the hot air and the steam being supplied to the inner cabinet have a rising nature.

That is, once the machinery room 7 is provided to supply the hot air or the steam to the lower portion of the inner cabinet 2, the steam or the hot air can be supplied to an inside of the inner cabinet uniformly even if there is no separate circulating unit.

FIG. 4 illustrates a perspective view of the machinery room, schematically. For convenience's sake, FIG. 4 illustrates major elements including the air supply unit 71 and the steam generator 72 only, but not pipelines which connect above elements.

Referring to FIG. 4, the machinery room 7 has the air supply unit 71 positioned therein for supplying air or hot air to the inner cabinet 2.

The air supply unit 71 of the present invention includes an inlet 711 connected to the filter unit 25 (See FIG. 5) provided to the inner cabinet 2, an outlet 715 connected to the air inlet 23 of the inner cabinet 2, and a heat exchanger unit 713 provided between the inlet and the outlet.

The heat exchanger unit 713 can be a heat pump, and the heat pump is provided with an evaporator 7131, a compressor 7133, a condenser 7135, and an expansion valve (not shown), through which refrigerant circulates, for dehumidifying and heating the air.

That is, since the evaporator 7131 absorbs latent heat from surrounding air as the refrigerant evaporates, the evaporator 7131 removes water from the air in contact with the evaporator, and since the condenser 7135 discharges heat generated in a course of condensing of the refrigerant, the condenser 7135 heats the air in contact with the condenser 7135. Therefore, the air introduced to the air supply unit 71 is supplied to the inner cabinet 2 after dehumidified and heated through the evaporator 7131 and the condenser 7135.

Though the air heated by the heat pump thus can have a temperature more or less lower than the air heated by a related art electric heater, the air can be dehumidified without using a separate dehumidifier. Therefore, the air supplied to a holding space by the heat pump is 'low temperature air' relatively (In this instance, the 'low temperature' means a temperature that is not low absolutely, but a temperature relatively low in comparison to related art heated air though the air is heated air). The clothes treating apparatus in accordance with a preferred embodiment of the present invention can prevent the clothes from deforming or damaging due to a high temperature in a case the clothes treating apparatus of the present invention performs a process for refreshing or drying the clothes by supplying the low temperature dry air to the clothes.

At the end, the air supplied by the heat pump in the clothes treating apparatus in accordance with a preferred embodiment of the present invention can make easy drying and refreshing of the clothes since the heat pump supplies dehumidified air without a dehumidifier even though the air has a temperature lower than the hot air from the related art clothes treating apparatus.

The inlet 711 is provided to match with the filter unit 25 of the inner cabinet for filtering air being introduced to the air supply unit 71 from the inner cabinet 2 for removing foreign matters possibly contained in the air to supply only clean air to the inner cabinet.

In the meantime, the filter unit is provided to a bottom of the inner cabinet for easy cleaning of the filter unit 25.

The outlet 715 can further include a discharge fan 717 connected to the air inlet 23 of the inner cabinet for making easy air flow in flowing the hot air heated by heat exchange to the inner cabinet.

In the meantime, the machinery room 7 can further include the steam generator 72 for supplying steam to the inner cabinet 2, selectively.

The steam generator 72 can be provided to include a water storage unit (not shown) for storage of water and a heater (not shown) for heating the stored water to generate the steam or can be provided to generate mist from the stored water in the water storage unit by using ultrasonic vibration means (not shown).

As a water supply source for supplying the water to the water storage unit in the steam generator 72, an external utility water tap can be used, or a container type water supply source provided to one side of the machinery room 7 can be used.

Preferably, the container type water supply source can be provided to a machinery room door 73 detachably mounted to one side of the machinery room 7, and the water supply source can be mounted to the door 73, detachably. Accordingly, the user can dismount the water supply source from the machinery room 7, fill the water storage unit with water, and mount the water supply source to the machinery room door 73, again.

And, the steam generated at the steam generator 72 is supplied to the inner cabinet through the spray nozzle (not shown) provided to the steam inlet 21. The steam generator 72 and the spray nozzle (not shown) can be connected with a pipe (not shown).

The machinery room 7 can have a cooling fan 74 mounted to a rear side thereof. The cooling fan 74 draws air from an outside of the machinery room 7 into the machinery room 7 for preventing a temperature of the machinery room 7 from rising excessively by the air supply unit 71 and the steam generator 72.

In the meantime, the outer cabinet 1 which forms an exterior of the clothes treating apparatus can further include a machinery room cabinet 13 for opening one side of the machinery room to make mounting and repair of the air supply unit 71 and the steam generator 72 easy.

Accordingly, it is preferable that a rear side of the outer cabinet 1 is divided into the machinery room cabinet 13 and a rear cabinet 11 over the machinery room cabinet 13.

Figure 5:
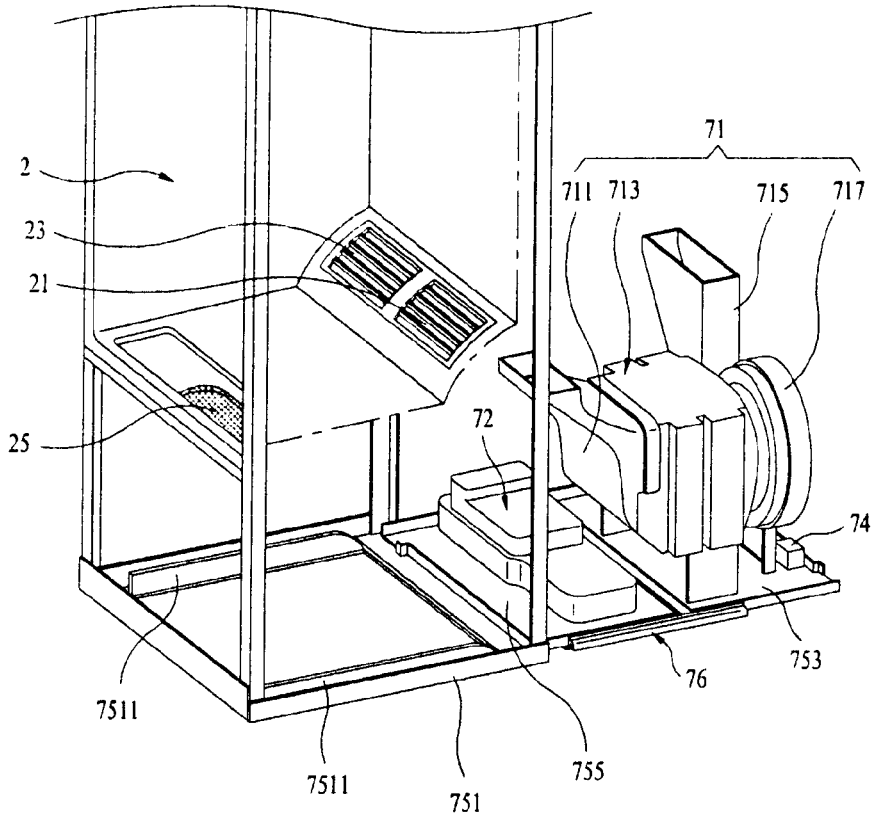
FIG. 5 illustrates a perspective view showing a process for mounting an air supply unit and a steam generator in a machinery room.

FIG. 5 illustrates a perspective view showing a process for mounting the air supply unit and the steam generator in the machinery room. A structure which is favorable for mounting and maintenance of the air supply unit and the steam generator will be described.

Provided to the base frame 751 which forms the bottom surface of the machinery room, there are an air module base 753 having the air supply unit 71 supported thereon and a steam module base 755 having the steam generator 72 supported thereon.

The steam module base and the air module base are coupled with a base coupling member 76 which, not only couples the module bases 753 and 755 together, but also makes the module bases coupled thus to be detachable from the base frame, easily.

Figure 6:
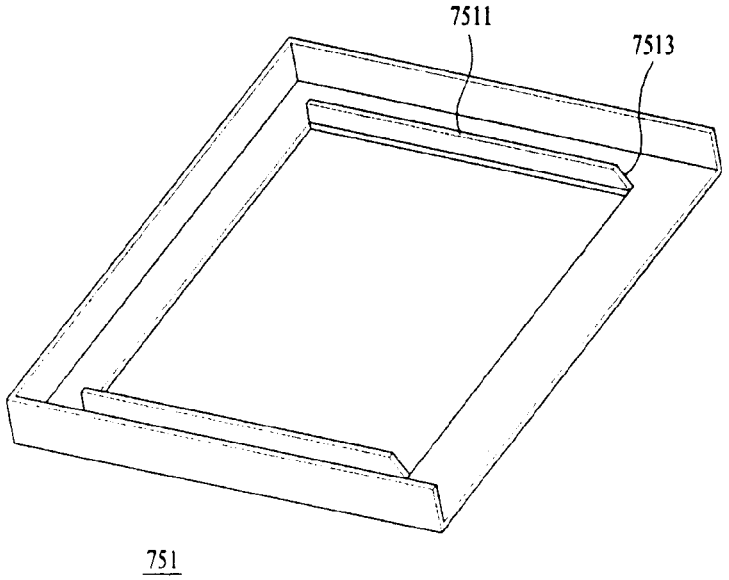
FIG. 6 illustrates a perspective view of a base frame.

FIG. 6 illustrates a perspective view of the base frame, including sliding guides 7511 which are upward extensions from opposite ends of the base frame with sloped portions 7513 respectively for making coupling of the steam module base and the air module base, easy.

Figure 7:
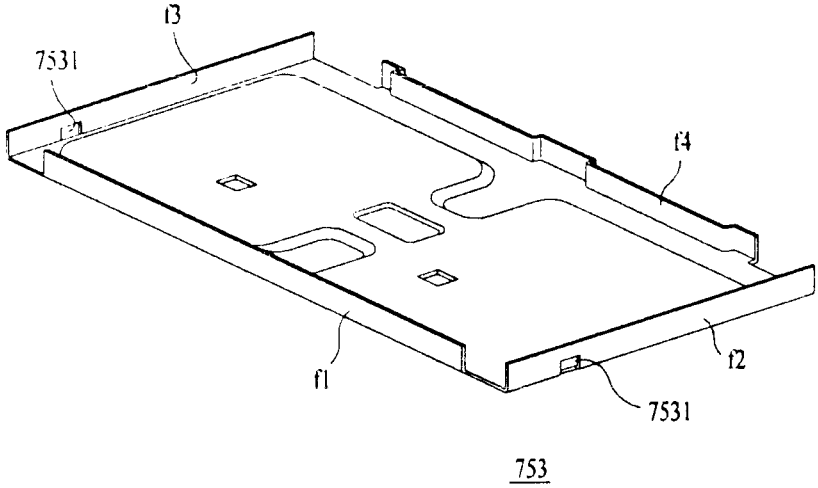
FIG. 7 illustrates a perspective view of an air module base.

FIG. 7 illustrates a perspective view of the air module base 753, including flanges f1, f2, f3 and f4 formed bent upward from edges thereof, to have a fastening projection hole 7531 in each of the opposite flanges f2 and f3 for placing a base fastening projection 767 of the base coupling member 76 to be described later therein, respectively.

In the meantime, though not shown, the steam module base 755 can have a structure the same with the air module base. This is for saving a production cost by making parts interchangeable.

Figure 8:
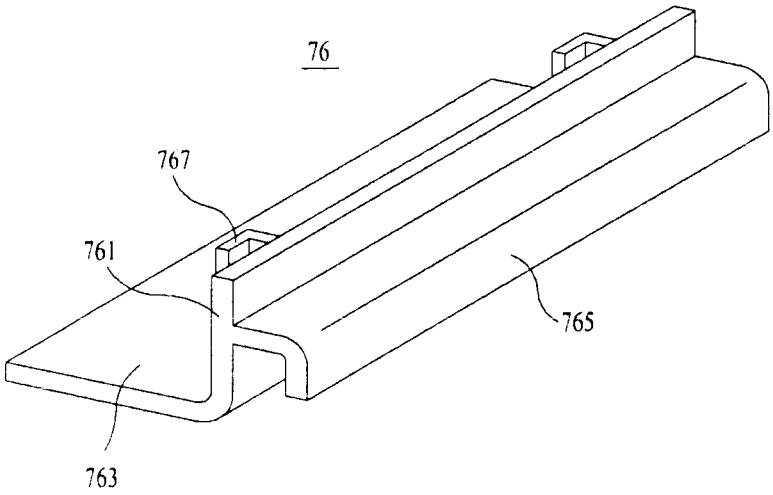
FIG. 8 illustrates a perspective view of a base coupling member.

FIG. 8 illustrates a perspective view of the base coupling member 76, for making the steam module base and the air module base detachable from the machinery room 7 as one unit for easy mounting and maintenance of the steam module base and the air module base.

The base coupling member 76 includes a side body 761 in contact with the flange f2 of the steam module base and the air module base having the fastening projection hole 7531 formed therein, a supporting body 763 for supporting bottom surfaces of the steam module base and the air module base, a guide receiving rib 765 for receiving a sliding guide 7511 of the base frame 751, and the base fastening projections 767 for being inserted into the fastening projection receiving holes 7531 in the steam module base and the air module base, respectively.

The base coupling member 76 can couple the module bases 753 and 755 together by positioning the steam module base and the air module base having the steam generator and the air supplying unit secured thereto respectively such that front frames f1 of the module bases are in contact with each other, and placing the base fastening projection 767 of the base coupling member in the fastening projection receiving hole 7531 and moving the base fastening projection 767 in a front or rear direction of a length direction of the side body 761.

Then, the steam module base and the air module base coupled thus are slidably coupled to the base frame 751 provided on a bottom of the machinery room, when the sliding guides 7511 of the base frame are received in the guide receiving ribs 765 to support the module bases, respectively.

Eventually, the steam generator and the air supply unit are mounted slidably attachable/detachable to/from the machinery room 7.

In the meantime, if the steam generator or the air supplying unit is out of order, since the steam module base and the air module base can be drawn out of the machinery room through the rear side of the machinery room after removal of the machinery room cabinet 13 from the rear side of the machinery room 7, only the steam generator and the air supplying unit can be separated from the machinery room without separating an entire outer cabinet.

Figure 9:
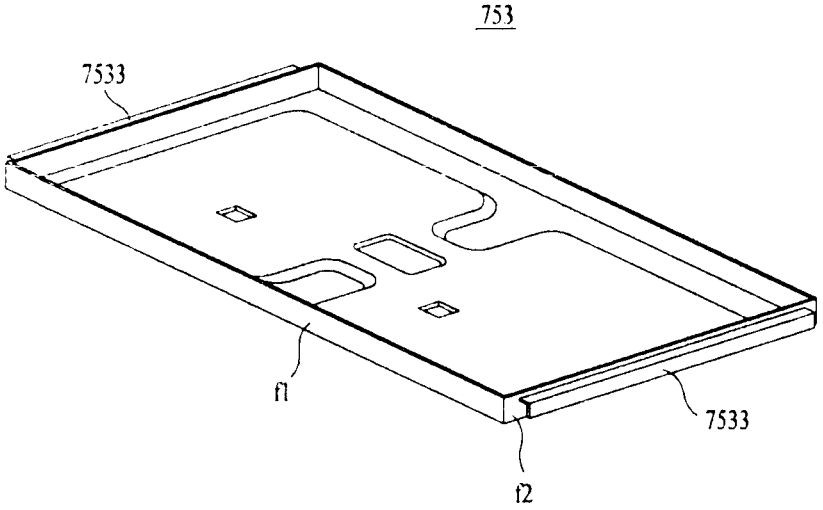
FIG. 9 illustrates a perspective view of an air module base in accordance with another preferred embodiment of the present invention.

FIG. 9 illustrates a perspective view of an air module base in accordance with another preferred embodiment of the present invention.

The air module base of the embodiment enables the steam module base and the air module base to be mounted slidably attachable/detachable to/from the machinery room 7 without the base coupling member that couples the module bases together.

That is, if the guide receiving rib 7533 is provided to the flange f2 of the air module base for receiving the sliding guide 7511 of the base frame, and the steam module base is made to have the same structure as the air module base, the air module base and the steam module base can be mounted slidably attachable/detachable to/from the machinery room even without the base coupling member.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating apparatus comprising:

an inner cabinet which forms a space for holding clothes;

a machinery room provided separate from the inner cabinet;

a base frame forming the bottom surface of the machinery room;

an air module base supporting an air supplying unit which is to supply air or hot air to the inner cabinet;

a steam module base supporting a steam generator which is to supply steam to the inner cabinet, wherein the air module base and the steam module base are provided separately;

a base coupling member to couple the steam module base and the air module base together and to make the module bases coupled to be slidably detachable from the base frame, wherein the base frame further includes a sliding guide which is upwardly extended from the base frame for supporting the base coupling member, and wherein the base coupling member further includes a side body in contact with outside circumferential surfaces of the steam module base and the air module base, and a guide receiving rib is extended from an outside surface of the side body and bent toward the base frame direction for receiving the sliding guide, wherein the air module base is mounted attachable/detachable to/from the base coupling member and the steam module base is mounted attachable/detachable to/from the base coupling members, wherein the base coupling member further includes base fastening projections projected from the side body toward the steam module base and the air module base, respectively, and wherein the steam module base and the air module base include fastening projection receiving holes for receiving the base fastening projections therein, respectively.

2. The laundry treating apparatus as claimed in claim 1, wherein the machinery room is provided to a lower portion of the inner cabinet.

3. The laundry treating apparatus as claimed in claim 2, wherein the base coupling member further includes a supporting body provided bent from the side body for supporting bottoms of the steam module base and the air module base.

4. The laundry treating apparatus as claimed in claim 2, wherein the sliding guides further include sloped portions in a direction the steam module base and the air module base are inserted, respectively.

5. The laundry treating apparatus as claimed in claim 1, further comprising:

an outer cabinet which forms an exterior of the laundry treating apparatus and provides a space in which the inner cabinet and the machinery room are formed, and the outer cabinet includes a machinery room cabinet provided to a rear side of the machinery room for selectively opening one side of the machinery room and a rear cabinet located over the machinery cabinet to cover a rear side of the inner cabinet.

* * * * *